US011153679B1

(12) United States Patent
Hwang

(10) Patent No.: US 11,153,679 B1
(45) Date of Patent: Oct. 19, 2021

(54) BROADBAND SPEAKER AND CONTROL METHOD THEREOF

(71) Applicants: HYUNDAI MOTOR COMPANY, Seoul (KR); KIA MOTORS CORPORATION, Seoul (KR)

(72) Inventor: Yonghwan Hwang, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/089,954

(22) Filed: Nov. 5, 2020

(30) Foreign Application Priority Data

Jul. 27, 2020 (KR) ..... 10-2020-0093229

(51) Int. Cl.

| | |
|---|---|
| ***H04R 1/00*** | (2006.01) |
| ***H04R 29/00*** | (2006.01) |
| ***H04R 1/24*** | (2006.01) |
| ***H04R 7/12*** | (2006.01) |
| ***H04R 7/18*** | (2006.01) |
| ***H04R 9/02*** | (2006.01) |
| ***H04R 3/00*** | (2006.01) |
| ***H04R 9/04*** | (2006.01) |
| ***H04R 9/06*** | (2006.01) |

(52) U.S. Cl.
CPC ..... *H04R 1/24* (2013.01); *H04R 3/00* (2013.01); *H04R 7/127* (2013.01); *H04R 7/18* (2013.01); *H04R 9/025* (2013.01); *H04R 9/046* (2013.01); *H04R 9/06* (2013.01); *H04R 29/003* (2013.01); *H04R 2201/028* (2013.01)

(58) Field of Classification Search
CPC . H04R 1/24; H04R 3/00; H04R 7/127; H04R 7/18; H04R 9/025; H04R 9/046; H04R 9/06; H04R 29/003; H04R 2201/028
USPC ..... 381/59, 402
See application file for complete search history.

(56) References Cited

U.S. PATENT DOCUMENTS

2006/0204028 A1* 9/2006 Lim ..... H04R 9/063 381/396

FOREIGN PATENT DOCUMENTS

| | | | |
|---|---|---|---|
| JP | H07-250394 | A | 9/1995 |
| JP | 2000-138996 | A | 5/2000 |
| JP | 4173382 | B2 | 10/2008 |

* cited by examiner

*Primary Examiner* — Ammar T Hamid
(74) *Attorney, Agent, or Firm* — Morgan, Lewis & Bockius LLP

(57) ABSTRACT

A broadband speaker includes: a first vibration plate configured to operate in a high frequency band, a second vibration plate disposed coaxially outside the first vibration plate, a first voice coil connected to the first vibration plate to vibrate the first vibration plate, a second voice coil disposed coaxially outside the first voice coil and connected to the second vibration plate, a magnet assembly configured to form a magnetic field, an amplifier configured to apply a first output signal of a high frequency band to the first voice coil and a second output signal of a frequency band lower than that of the first output signal to the second voice coil, and a controller configured to control the amplifier to apply a signal for suppressing vibration of the second vibration plate to the second voice coil when the first output signal is applied to the first voice coil.

8 Claims, 5 Drawing Sheets

BROADBAND SPEAKER AND CONTROL METHOD THEREOF

CROSS-REFERENCE TO RELATED APPLICATION(S)

This application is based on and claims priority to Korean Patent Application No. 10-2020-0093229, filed on Jul. 27, 2020, in the Korean Intellectual Property Office, the disclosure of which is incorporated by reference herein in its entirety.

TECHNICAL FIELD

The disclosure relates to a broadband speaker capable of outputting low-pitched and high-pitched sounds through a single speaker and a control method thereof.

BACKGROUND

A speaker having one vibration plate is difficult to output excellent sound in the entire audible frequency band. In order to output excellent sound in the entire audible frequency band, it is necessary to use speakers for each of a high frequency band, a middle frequency band, and a low frequency band.

However, when a multi-speaker system in which a plurality of speakers is used is installed in a narrow space like a vehicle, the installation space may be restricted. Therefore, in a speaker system applied to a narrow space like a vehicle, a speaker in which a low-pitched vibration plate and a high-pitched vibration plate are coaxially formed in one frame may be used.

However, a typical coaxial speaker is constructed in a way that a high-pitched vibration plate protrudes from a central portion of a low-pitched vibration plate in a cone shape, and therefore, the high-pitched vibration plate may be damaged by an external force during the logistics or assembly process. In addition, when the high-pitched vibration plate is operated, vibration is transmitted to the low-pitched vibration plate, which may cause sound distortion.

SUMMARY

It is an aspect of the disclosure to provide a broadband speaker capable of excellently outputting low-pitched and high-pitched sounds through a single speaker and a control method thereof.

Additional aspects of the disclosure will be set forth in part in the description which follows and, in part, will be obvious from the description, or may be learned by practice of the disclosure.

In accordance with an aspect of the disclosure, a broadband speaker includes: a first vibration plate configured to operate in a high frequency band; a second vibration plate disposed outside the first vibration plate and configured to vibrate in a lower frequency band than the first vibration plate; a first voice coil connected to the first vibration plate to vibrate the first vibration plate; a second voice coil disposed outside the first voice coil and connected to the second vibration plate to vibrate the second vibration plate; a magnet assembly configured to form a magnetic field for operations of the first voice coil and the second voice coil, respectively; an amplifier configured to apply a first output signal of a high frequency band to the first voice coil and a second output signal of a frequency band lower than that of the first output signal to the second voice coil; and a controller configured to control the amplifier to apply a signal for suppressing vibration of the second vibration plate to the second voice coil when the first output signal is applied to the first voice coil.

The controller may control to apply a reverse phase signal of a current measured in the second voice coil to the second voice coil.

The controller may control to apply a reverse phase signal of the first output signal to the second voice coil when the first output signal is a frequency corresponding to a multiple of a natural frequency of the second vibration plate.

The first vibration plate may be formed in a dome shape, and an outer edge thereof may be connected to the first voice coil.

The first vibration plate may have an outer edge connected to a connection portion between the second vibration plate and the second voice coil by a first flexible connector, and the second vibration plate may have an outer edge connected to a housing by a second flexible connector.

The magnet assembly may include a disc-shaped first yoke installed inside the first voice coil such that a circumference thereof is close to the first voice coil, a ring-shaped second yoke installed outside the second voice coil such that an inner circumference thereof is close to the second voice coil, a first magnet disposed at a central portion with one side coupled to the first yoke, a cylindrical second magnet disposed outside the first magnet with one side coupled to the second yoke, a disc-shaped third yoke coupled to the other sides of the first magnet and the second magnet, and a fourth yoke disposed between the first magnet and the second magnet and forming a magnetic circuit by having one side coupled to the third yoke and the other side entering a space between the first voice coil and the second voice coil.

In accordance with another aspect of the disclosure, a method of controlling a broadband speaker, which comprises: a first vibration plate configured to operate in a high frequency band; a second vibration plate disposed outside the first vibration plate and configured to vibrate in a lower frequency band than the first vibration plate; a first voice coil connected to the first vibration plate to vibrate the first vibration plate; a second voice coil disposed outside the first voice coil and connected to the second vibration plate to vibrate the second vibration plate; a magnet assembly configured to form a magnetic field for operations of the first voice coil and the second voice coil, respectively; an amplifier configured to apply a first output signal of a high frequency band to the first voice coil and a second output signal of a frequency band that is lower than that of the first output signal to the second voice coil; and a controller configured to control the amplifier to apply a signal for suppressing vibration of the second vibration plate to the second voice coil when the first output signal is applied to the first voice coil, includes: determining whether the first output signal is applied to the first voice coil; measuring a current generated in the second voice coil upon determining that the first output signal is applied to the first voice coil; and controlling to apply a reverse phase signal of the first output signal to the second voice coil.

A method of controlling a broadband speaker, which comprises: a first vibration plate configured to operate in a high frequency band; a second vibration plate disposed outside the first vibration plate and configured to vibrate in a lower frequency band than the first vibration plate; a first voice coil connected to the first vibration plate to vibrate the first vibration plate; a second voice coil disposed outside the first voice coil and connected to the second vibration plate to vibrate the second vibration plate; a magnet assembly configured to form a magnetic field for operations of the first voice coil and the second voice coil, respectively; an amplifier configured to apply a first output signal of a high frequency band to the first voice coil and a second output signal of a frequency band that is lower than that of the first output signal to the second voice coil; and a controller configured to control the amplifier to apply a signal for suppressing vibration of the second vibration plate to the second voice coil when the first output signal is applied to the first voice coil, may include: determining whether the first output signal is a frequency corresponding to a multiple of a natural frequency of the second vibration plate; and applying a reverse phase signal of the first output signal to the second voice coil upon determining that the first output signal is a frequency corresponding to a multiple of the natural frequency of the second vibration plate.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, exemplary embodiments of the present disclosure will be described in detail with reference to the accompanying drawings. The embodiments described below are provided by way of example so that those skilled in the art will be able to fully understand the spirit of the disclosure. The disclosure is not limited to the embodiments described below, but may be embodied in other forms. In order to clearly explain the disclosure, parts not related to the description are omitted from the drawings, and the width, length, thickness, etc. of the components may be exaggerated for convenience.

Figure 1:
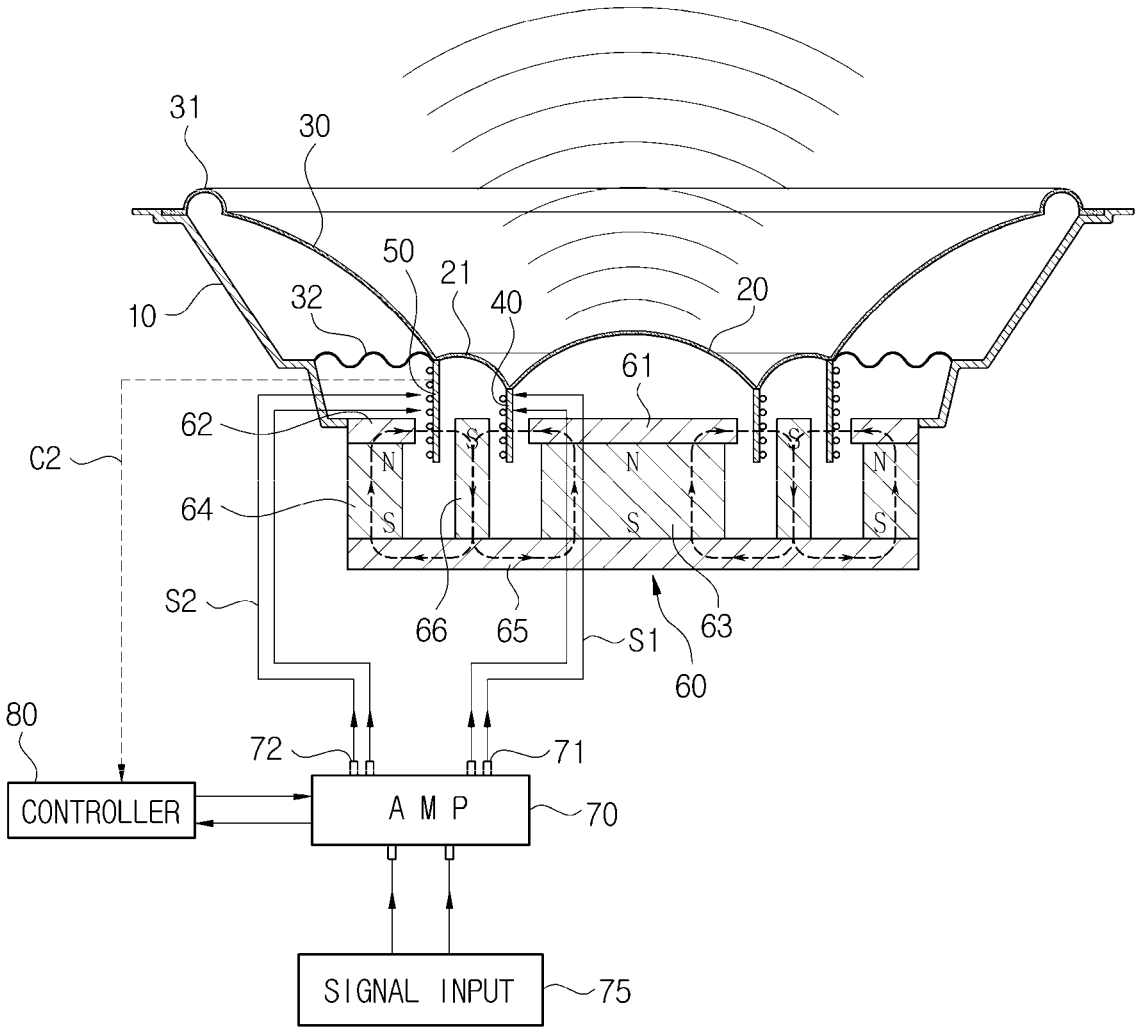
FIG. 1 illustrates a state in which a high-pitched sound is output by a first vibration plate of a broadband speaker according to an embodiment of the present disclosure.
Figure 2:
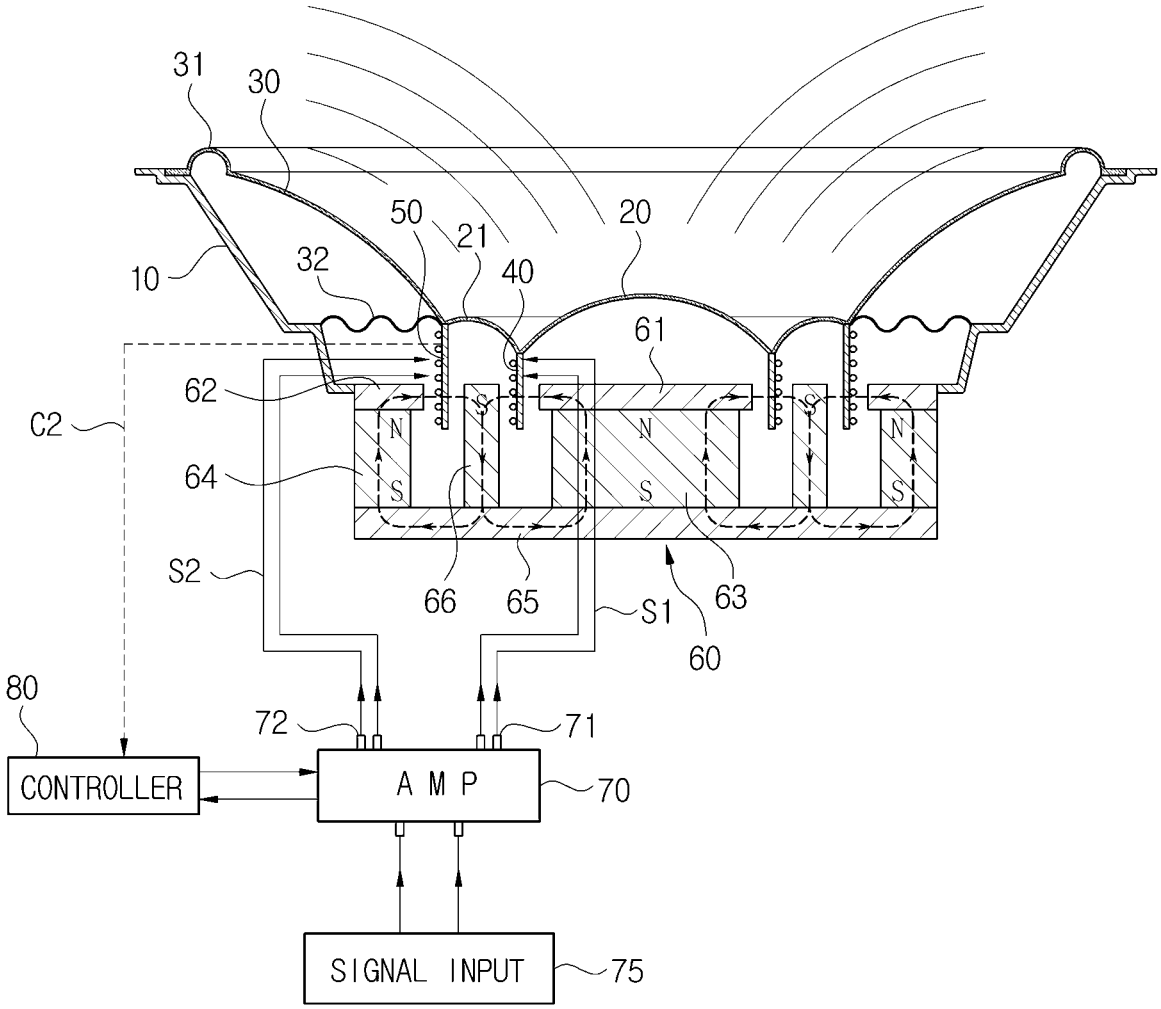
FIG. 2 illustrates a state in which a low-pitched sound is output by a second vibration plate of the broadband speaker according to an embodiment of the present disclosure.

Referring to FIGS. 1 and 2, a broadband speaker according to an embodiment of the present disclosure includes a housing 10, a first vibration plate 20, a second vibration plate 30, a first flexible connector 21, a second flexible connector 31, a first voice coil 40, a second voice coil 50, a magnet assembly 60, an amplifier 70, and a controller 80.

The housing 10 may be made of a metal material in a cone shape. The housing 10 may accommodate the first vibration plate 20 and the second vibration plate 30 therein to protect the first vibration plate 20 and the second vibration plate 30 from external impacts. An edge of the housing 10 may be fixed to an installation position of a vehicle and the like.

The first vibration plate 20 may have a dome shape and may be installed in an inner central portion of the housing 10. The first vibration plate 20 may vibrate in a high frequency band to output an excellent high-pitched sound.

The second vibration plate 30 may have a dome shape and may be disposed on an outer periphery of the first vibration plate 20 in the housing 10 coaxially with the first vibration plate 20. The second vibration plate 30 may vibrate in a low frequency band lower than that of the first vibration plate 20 to output an excellent mid-bass sound.

An outer edge of the first vibration plate 20 may be connected to an inner edge of the second vibration plate 30 by the first flexible connector 21. The outer edge of the second vibration plate 30 may be connected to the edge of the housing 10 by the second flexible connector 31. The first flexible connector 21 and the second flexible connector 31 may be made of a flexible material that minimizes transmission of vibration. The first flexible connector 21 and the second flexible connector 31 may be made of a material such as thin paper, rubber, silicone, and sponge.

The first voice coil 40 may vibrate the first vibration plate 20 through interaction with the magnet assembly 60 forming a magnetic field. The first voice coil 40 may be configured such that a coil is wound on an outer surface of a cylindrical bobbin, and one end thereof is connected to the outer edge of the first vibration plate 20. The first voice coil 40 vibrates the first vibration plate 20 when a first output signal S1 in the high frequency band is applied.

The second voice coil 50 is disposed outside the first voice coil 40 coaxially with the first voice coil 40, and may vibrate the second vibration plate 30 through interaction with the magnet assembly 60 forming a magnetic field. The second voice coil 50 may be configured such that a coil is wound on an outer surface of a cylindrical bobbin, and one end thereof is connected to the inner edge of the second vibration plate 30. The second voice coil 50 vibrates the second vibration plate 30 when a second output signal S2, which is relatively lower than the first output signal S1, is applied. The second voice coil 50 may be stably supported in a vibration range by being supported by a damper 32 whose upper portion extends from the housing 10.

The magnet assembly 60 forms a magnetic field for the operation of the first voice coil 40 and the second voice coil 50. The magnet assembly 60 includes a first yoke 61, a second yoke 62, a first magnet 63, a second magnet 64, a third yoke 65, and a fourth yoke 66.

The first yoke 61 has a disk shape and is installed inside the first voice coil 40 such that a circumference thereof is close to the first voice coil 40. The first yoke 61 induces a magnetic field to flow from the first magnet 63 to the fourth yoke 66 via the first voice coil 40.

The second yoke 62 has a ring shape and is installed outside the second voice coil 50 such that an inner circumference thereof is close to the second voice coil 50. The second yoke 62 induces a magnetic field to flow from the second magnet 64 to the fourth yoke 66 via the second voice coil 50.

The first magnet 63 has a cylindrical shape having a diameter smaller than that of the first yoke 61 and is disposed at a central portion of the first yoke 61 with one side thereof coupled to the first yoke 61.

The second magnet 64 has a hollow cylindrical shape such that an outer diameter thereof corresponds to that of the second yoke 62 and an inner diameter thereof is larger than that of the second yoke 62, and is disposed outside the first magnet 63 coaxially with the first magnet 63 with one side thereof coupled to the second yoke 62.

The third yoke 65 has a disk shape having an outer diameter corresponding to the outer diameter of the second magnet 64 and is coupled to the other sides of the first magnet 63 and the second magnet 64. The third yoke 65 connects the first magnet 63 and the second magnet 64, and at the same time induces a magnetic field to flow from the fourth yoke 66 to the first magnet 63 or the second magnet 64.

The fourth yoke 66 is formed in a cylindrical shape and is disposed in a space between the first magnet 63 and the second magnet 64. The fourth yoke 66 forms a magnetic circuit by having one side coupled to the third yoke 65 and the other side entering a space between the first voice coil 40 and the second voice coil 50. The fourth yoke 66 induces a magnetic field to flow from the first yoke 61 or the second yoke 62 side to the third yoke 65.

The magnet assembly 60 may be stably supported by fixing an edge of the second yoke 62 to the housing 10.

The amplifier 70 includes a first signal output 71 for applying the first output signal S1 of a high frequency band to the first voice coil 40, and a second signal output 72 for applying the second output signal S2 of a low frequency band relatively lower than the first output signal S1 to the second voice coil 50.

When an input signal is applied from a signal input unit 75, the amplifier 70 may vibrate the first vibration plate 20 by applying the first output signal S1 to the first voice coil 40 to output a high-pitched sound through the first vibration plate 20. The amplifier 70 may vibrate the second vibration plate 30 by applying the second output signal S2 to the second voice coil 50 to output a low-pitched sound through the second vibration plate 30. A range of the first output signal S1 and a range of the second output signal S2 may be preset in consideration of vibration frequency bands to which the first and second vibration plates 20 and 30 respond.

Figure 3:
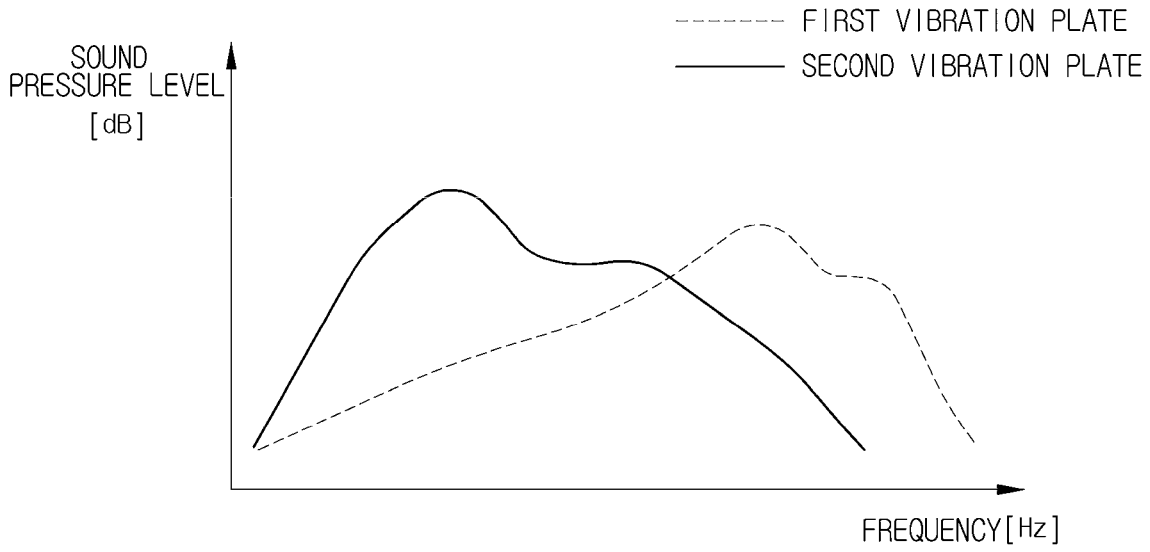
FIG. 3 is a graph illustrating output characteristics of the first vibration plate and the second vibration plate of the broadband speaker according to an embodiment of the present disclosure.

Therefore, as illustrated in FIG. 3, the broadband speaker according to the present embodiment may excellently output high-frequency sound through the first vibration plate 20 and may excellently output low-frequency sound through the second vibration plate 30. That is, excellent sound may be output from a low frequency band to a high frequency band using one speaker.

When a high-frequency sound is output, as illustrated in FIG. 1, the first output signal S1 is applied and the second output signal S2 is blocked so that only the first vibration plate 20 vibrates, thereby outputting excellent high-pitched sound. On the other hand, when low-frequency sound is output, as illustrated in FIG. 2, the first output signal S1 is blocked and the second output signal S2 is applied so that only the second vibration plate 30 vibrates, thereby outputting excellent mid-bass-pitched sound. Output in a specific frequency band may be improved by simultaneously applying the first output signal S1 and the second output signal S2 so that the first vibration plate 20 and the second vibration plate 30 vibrate simultaneously.

The broadband speaker according to the present disclosure may include the controller 80 configured to control the amplifier 70 to apply a signal for suppressing vibration of the second vibration plate 30 to the second voice coil 50 when the first output signal S1 is applied to the first voice coil 40 for an excellent high-pitched sound output.

The second vibration plate 30 may vibrate under the influence of vibration transmitted through the first flexible connector 21 in a situation in which the first output signal S1 is applied to the first voice coil 40 for an high-pitched sound output. In this case, the controller 80 may suppress abnormal vibration of the second vibration plate 30 by measuring a current C2 generated from the second voice coil 50 and then controlling the amplifier 70 to apply a signal corresponding to a reverse phase of the current C2 to the second voice coil 50.

When sound waves transmitted from the first vibration plate 20 is a resonance frequency of the second vibration plate 30, the second vibration plate 30 may vibrate by the sound waves transmitted through space even in a state in which the second voice coil 50 is substantially stopped by apply the signal corresponding to the reverse phase of the current C2 to the second voice coil 50. In this case, when the first output signal S1 applied to the first voice coil 40 is a frequency corresponding to a multiple of a natural frequency of the second vibration plate 30, the controller 80 may suppress the vibration of the second vibration plate 30 by applying a reverse phase signal of the first output signal S1 to the second voice coil 50. Herein, the natural frequency of the second vibration plate 30 means a natural frequency of the second voice coil 50 in a stopped state.

Hereinafter, a control for suppressing the vibration of the second vibration plate 30 when a high-pitched sound is output through the first vibration plate 20 will be described.

Figure 4:
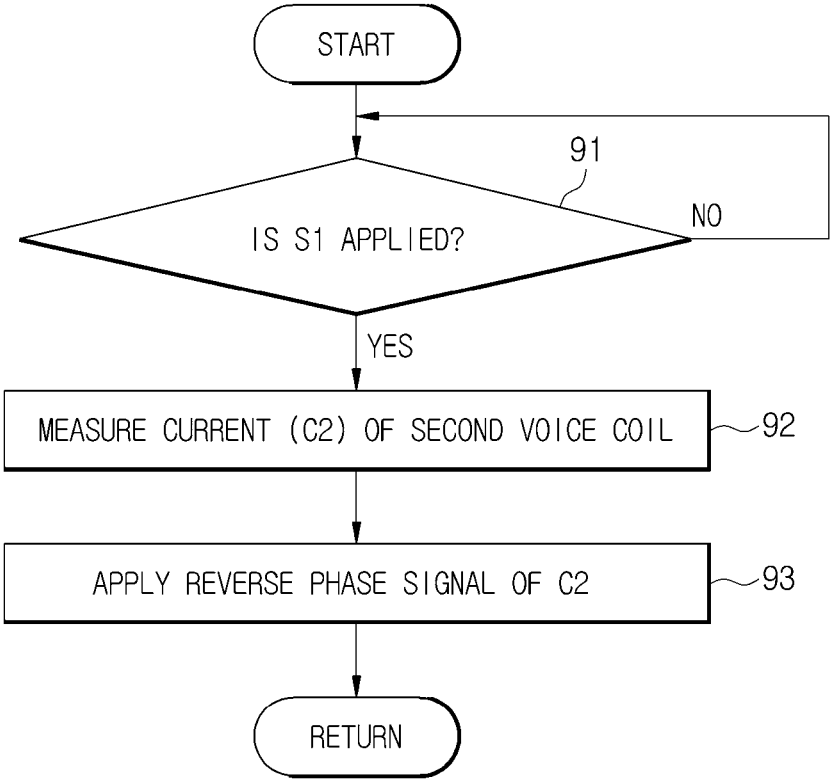
FIG. 4 is a flowchart illustrating a method of controlling the broadband speaker according to an embodiment of the present disclosure.

Referring to FIG. 4, the controller 80 determines whether the first output signal S1 is applied to the first voice coil 40 (91). This is to detect the first output signal S1 to determine whether a high-pitched sound is output by the first vibration plate 20.

When it is determined that the first output signal S1 is applied to the first voice coil 40, the current C2 generated in the second voice coil 50 is measured (92). Because the second vibration plate 30 and the second voice coil 50 are connected to the first vibration plate 20 by the first flexible connector 21, even if the second output signal S2 is not applied to the second voice coil 50, the second vibration plate 30 and the second voice coil 50 may vibrate abnormally due to the influence of the first vibration plate 20. In this case, the controller 80 may detect an abnormal vibration of the second voice coil 50 by measuring the current C2 generated from the second voice coil 50.

After measuring the current C2 of the second voice coil 50, the controller 80 suppresses vibration of the second voice coil 50 by applying a signal corresponding to the reverse phase of the current C2 generated from the second voice coil 50 to the second voice coil 50 (93).

As such, when the abnormal movement of the second voice coil 50 is suppressed while a high-pitched sound is output from the first vibration plate 20, an excellent high-pitched sound may be output by reducing noise caused by abnormal vibration of the second vibration plate 30.

When a sound wave transmitted through space from the first vibration plate 20 side is the resonance frequency of the second vibration plate 30, the second vibration plate 30 may vibrate even in a state in which the second voice coil 50 is substantially stopped by a signal corresponding to the reverse phase of the current C2.

Figure 5:
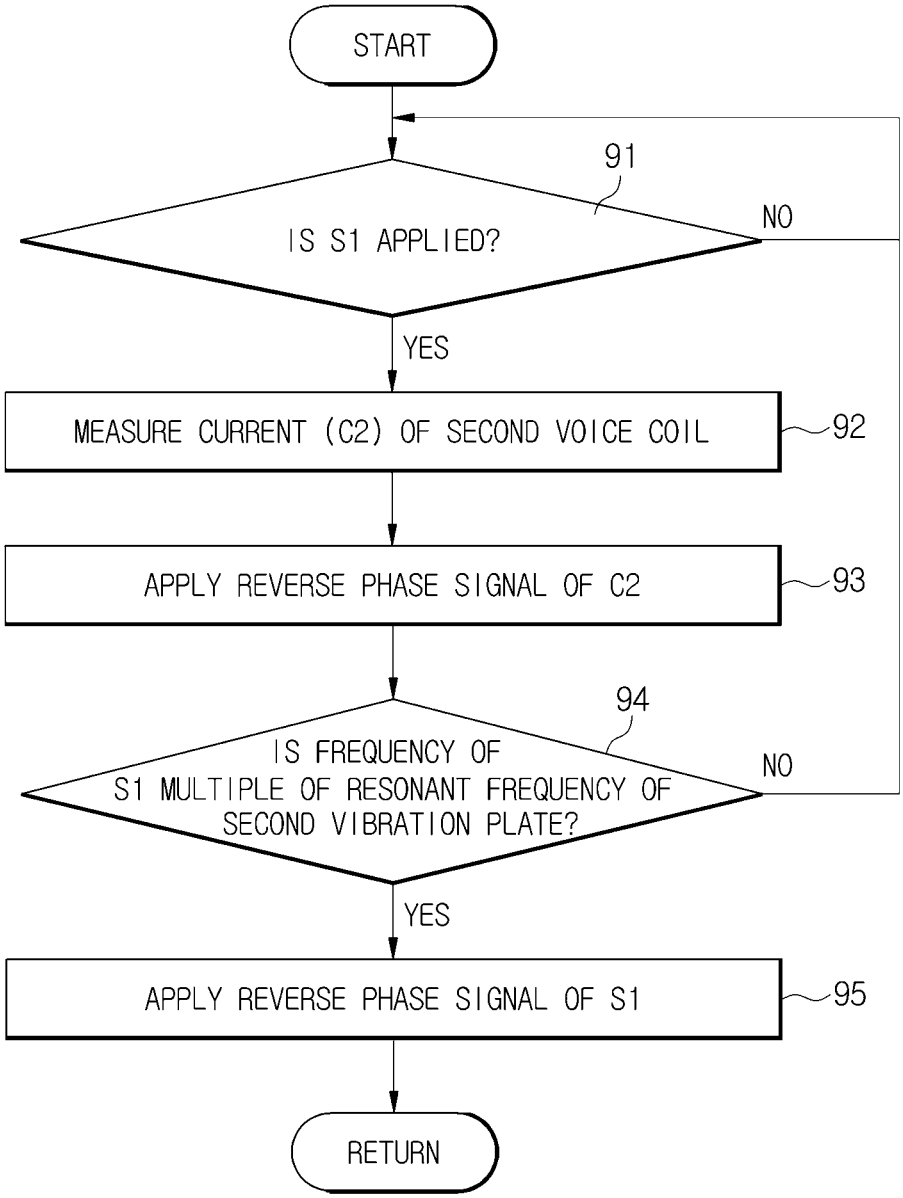
FIG. 5 illustrates a modified example of the method of controlling the broadband speaker according to an embodiment of the present disclosure.

In order to suppress the vibration of the second vibration plate 30, the controller 80 may control the operation of the second voice coil 50 after the operation 93, as in the example illustrated in FIG. 5. The controller 80 determines whether the first output signal S1 is a frequency corresponding to a multiple of the natural frequency of the second vibration plate 30 (94), and controls the amplifier 70 to apply the reverse phase signal of the first output signal S1 to the second voice coil 50 when the first output signal S1 is a frequency corresponding to a multiple of the natural frequency of the second vibration plate 30 (95).

As a result, because vibration of the second vibration plate 30 generated by sound waves transmitted through space may also be suppressed, an excellent high-pitched sound may be output.

As is apparent from the above, a broadband speaker according to an embodiment of the disclosure can output a high-frequency sound through a first vibration plate and output a low-frequency sound through a second vibration plate, so that excellent sound can be output from a low frequency band to a high frequency band using one speaker.

Further, the broadband speaker according to an embodiment of the present disclosure can suppress abnormal movement of a second voice coil and the second vibration plate by applying a reverse phase signal of a current measured in the second voice coil to the second voice coil when a high-pitched sound is output through the first vibration plate, so that an excellent high-pitched sound can be output.

Further, when a first output signal is a frequency corresponding to a multiple of a natural frequency of the second vibration plate in a process of outputting a high-pitched sound through the first vibration plate, the broadband speaker according to an embodiment of the disclosure can suppress vibration of the second vibration plate by applying a reverse phase signal of the first output signal to the second voice coil, so that an excellent high-pitched sound can be output.

What is claimed is:

1. A broadband speaker comprising:

a first vibration plate configured to operate in a high frequency band;

a second vibration plate disposed outside the first vibration plate and configured to vibrate in a lower frequency band than the first vibration plate;

a first voice coil connected to the first vibration plate to vibrate the first vibration plate;

a second voice coil disposed outside the first voice coil and connected to the second vibration plate to vibrate the second vibration plate;

a magnet assembly configured to form a magnetic field for operations of the first voice coil and the second voice coil, respectively;

an amplifier configured to apply a first output signal of a high frequency band to the first voice coil and a second output signal of a frequency band that is lower than that of the first output signal to the second voice coil; and a controller configured to control the amplifier to apply a signal for suppressing vibration of the second vibration plate to the second voice coil when the first output signal is applied to the first voice coil.

2. The broadband speaker according to claim 1, wherein the controller controls the amplifier to apply a reverse phase signal of a current measured in the second voice coil to the second voice coil.

3. The broadband speaker according to claim 2, wherein the controller controls the amplifier to apply a reverse phase signal of the first output signal to the second voice coil when the first output signal is a frequency corresponding to a multiple of a natural frequency of the second vibration plate.

4. The broadband speaker according to claim 1, wherein the first vibration plate has a dome shape, and an outer edge thereof is connected to the first voice coil.

5. The broadband speaker according to claim 1, wherein the first vibration plate has an outer edge connected to a connection portion between the second vibration plate and the second voice coil by a first flexible connector, and wherein the second vibration plate has an outer edge connected to a housing by a second flexible connector.

6. The broadband speaker according to claim 1, wherein the magnet assembly includes:

a disc-shaped first yoke disposed inside the first voice coil such that a circumference of the first yoke is spaced apart from and adjacent to the first voice coil;

a ring-shaped second yoke disposed outside the second voice coil such that an inner circumference of the second yoke is spaced apart from and adjacent to the second voice coil;

a first magnet disposed at a central portion with a first side coupled to the first yoke;

a cylindrical second magnet disposed outside the first magnet with a first side coupled to the second yoke;

a disc-shaped third yoke coupled to second sides of the first magnet and the second magnet, respectively; and a fourth yoke configured to form a magnetic circuit and arranged between the first magnet and the second magnet, the fourth yoke comprising a first side connected to the third yoke and a second side disposed in a space between the first voice coil and the second voice coil.

7. A method of controlling a broadband speaker, which comprises: a first vibration plate configured to operate in a high frequency band; a second vibration plate disposed outside the first vibration plate and configured to vibrate in a lower frequency band than the first vibration plate; a first voice coil connected to the first vibration plate to vibrate the first vibration plate; a second voice coil disposed outside the first voice coil and connected to the second vibration plate to vibrate the second vibration plate; a magnet assembly configured to form a magnetic field for operations of the first voice coil and the second voice coil, respectively; an amplifier configured to apply a first output signal of a high frequency band to the first voice coil and a second output signal of a frequency band that is lower than that of the first output signal to the second voice coil; and a controller configured to control the amplifier to apply a signal for suppressing vibration of the second vibration plate to the second voice coil when the first output signal is applied to the first voice coil; the method comprising:

determining, by the controller, whether the first output signal is applied to the first voice coil;

measuring, by the controller, a current generated in the second voice coil upon determining that the first output signal is applied to the first voice coil; and controlling, by the controller, the amplifier to apply a reverse phase signal of the first output signal to the second voice coil.

8. A method of controlling a broadband speaker which comprises: a first vibration plate configured to operate in a high frequency band; a second vibration plate disposed outside the first vibration plate and configured to vibrate in a lower frequency band than the first vibration plate; a first voice coil connected to the first vibration plate to vibrate the first vibration plate; a second voice coil disposed outside the first voice coil and connected to the second vibration plate to vibrate the second vibration plate; a magnet assembly configured to form a magnetic field for operations of the first voice coil and the second voice coil, respectively; an amplifier configured to apply a first output signal of a high frequency band to the first voice coil and a second output signal of a frequency band that is lower than that of the first output signal to the second voice coil; and a controller configured to control the amplifier to apply a signal for suppressing vibration of the second vibration plate to the second voice coil when the first output signal is applied to the first voice coil, the method comprising:

determining, by the controller, whether the first output signal is a frequency corresponding to a multiple of a natural frequency of the second vibration plate; and applying, by the amplifier, a reverse phase signal of the first output signal to the second voice coil upon determining that the first output signal is a frequency corresponding to a multiple of the natural frequency of the second vibration plate.

* * * * *